United States Patent [19]

Gilmore, Jr.

[11] Patent Number: 4,666,049

[45] Date of Patent: May 19, 1987

[54] SIDEBOOM EXCAVATOR WITH LIFTING MEANS

[75] Inventor: Charles P. Gilmore, Jr., Ash Flat, Ark.

[73] Assignee: Gilmore Transportation Services, Inc., Houston, Tex.

[21] Appl. No.: 811,900

[22] Filed: Dec. 20, 1985

[51] Int. Cl.[4] ..... B66C 23/26

[52] U.S. Cl. ..... 212/175; 212/257; 212/258; 212/261; 414/912

[58] Field of Search ..... 212/175, 223, 224–228, 212/233, 238, 255, 257, 258, 261; 37/117.5; 414/912

[56] References Cited

U.S. PATENT DOCUMENTS

| | | | |
|---|---|---|---|
| 156,028 | 10/1874 | Lewis | 212/228 |
| 2,003,599 | 6/1933 | Le Tourneau . | |
| 2,712,873 | 7/1955 | Peterson . | |
| 2,991,890 | 7/1961 | Kennedy . | |
| 3,176,861 | 4/1965 | Paul et al. | 212/228 |
| 3,236,391 | 2/1966 | Kennedy . | |
| 3,265,218 | 8/1966 | Stefanutti . | |
| 3,329,283 | 7/1967 | Wade . | |
| 3,764,021 | 10/1973 | Scheverpflug | 212/238 |
| 4,132,317 | 1/1979 | Arendt et al. . | |

*Primary Examiner*—Joseph F. Peters, Jr.
*Assistant Examiner*—Stephen P. Avila
*Attorney, Agent, or Firm*—Bruns and Wall

[57] ABSTRACT

An articulated arm-type excavator machine has a hydraulically actuated main boom and a side boom which is detachably mounted at its proximal end to the side of the tractor of the machine, and at its distal end to a trolley arrangement on the underside of the main boom. The detachable sideboom arrangement permits the machine to be employed either as an excavator or as a sideboom lifting device.

7 Claims, 5 Drawing Figures

SIDEBOOM EXCAVATOR WITH LIFTING MEANS

BACKGROUND OF THE INVENTION

This invention relates to articulated crane-type machines, such as hydraulic excavator machines. The invention also relates to sideboom-type cranes and side-lifting machines including the type of crane in which a side boom is mounted on the tractor of the machine.

The invention is more particularly directed to a crane-type machine in which a front attachment has a main boom that is combined with a sideboom attachment, this combination serving as a side-lifting machine.

Many sideboom cranes and side-lifting devices have been proposed in the prior art, for example, to be employed as pipe-laying cranes, etc. Typical of these cranes are those discussed in U.S. Pat. Nos. 4,132,317; 3,265,218; 3,236,391; 2,712,873; and 2,003,599. It has also been previously proposed to attach a side boom to a tractor, and typical arrangements are discussed in U.S. Pat. Nos. 3,329,283 and 2,991,890.

However, no one has previously employed an articulated hydraulic excavator machine as a sideboom-type, side-lifting device, nor has anyone previously proposed a detachable sideboom structure which can be combined with the main attachment boom of the excavator to adapt the excavator for such a purpose.

OBJECTS AND SUMMARY OF THE INVENTION

Accordingly, it is an object of this invention to provide an articulated crane-type machine which can be employed as a sideboom-type, side-lifting machine, and which avoids the drawbacks of the prior art.

It is another object of this invention to provide an excavator-type machine with sideboom structure that can be fitted onto the side of the machine and onto the main boom of the machine, so that the machine can be converted without difficulty from excavator use to sideboom lifter use.

In accordance with an aspect of this invention, an articulated crane-type machine, such as a hydraulic excavator, has a base that includes a tractor or transport assembly for moving the machine in a forward and a reverse direction, an overcarriage swingably mounted on the base, a drive for swinging the overcarriage in a generally horizontal plane, and a front attachment that includes a main boom having its proximal end mounted on the overcarriage for motion in a generally vertical arc, and a hydraulic boom cylinder or equivalent means for raising and lowering the boom in its arc. The overcarriage can be swung so that the front attachment is generally transverse to the direction of the tractor or transport assembly, i.e., so that the main boom extends transversely to the transport assembly. A detachable side boom is also provided. A mounting bracket attached to one side of the tractor pivotally mounts the proximal end of the side boom for swinging motion of the side boom in a generally vertical arc, and a trolley assembly or other suitable means, affixed to an underside of the main boom, slidably couples the distal end of the side boom to the main boom so that the sideboom distal end travels over a substantial portion of the length of the main boom. A hydraulic cylinder or equivalent means urges the distal end of the side boom to an operator-selected position along the main boom, and a cable hoist or other suitable lifting means are attached to the side boom, with a lifting device being suspended from the distal end of the side boom for the purpose of lifting an object, such as a pipe.

The above and many other objects, features, and advantages of this invention will be more fully understood from the ensuing detailed description of a preferred embodiment, when considered in connection with the accompanying drawing.

DETAILED DESCRIPTION OF THE PREFERRED EMBODIMENT

Figure 1:
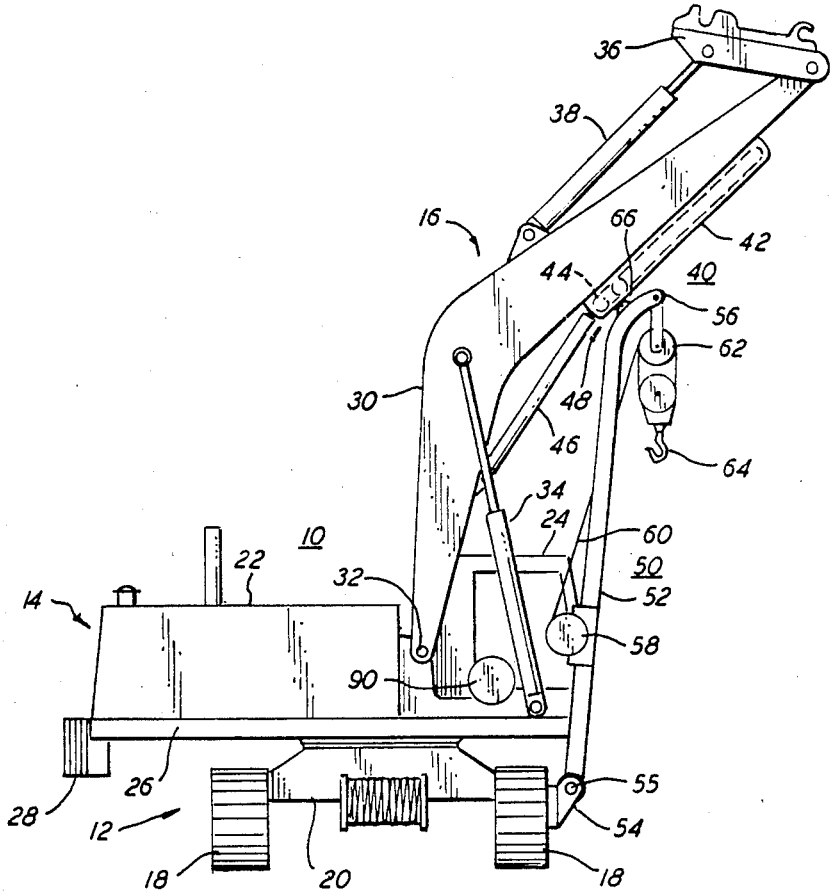
FIGS. 1 and 2 are front and side elevations, respectively, of the machine according to one embodiment of this invention, showing the main and side booms thereof in a raised position.
Figure 2:
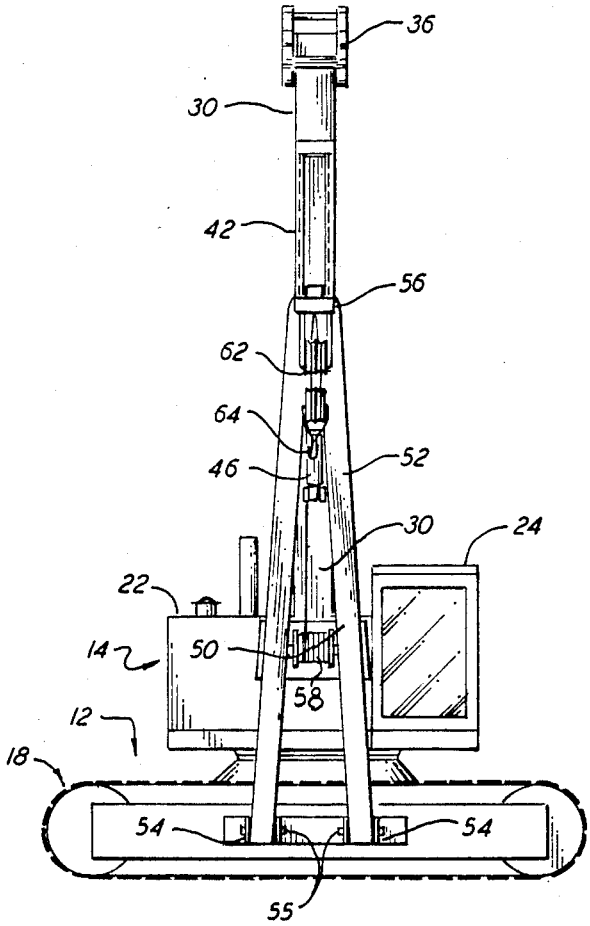
Figure 3:
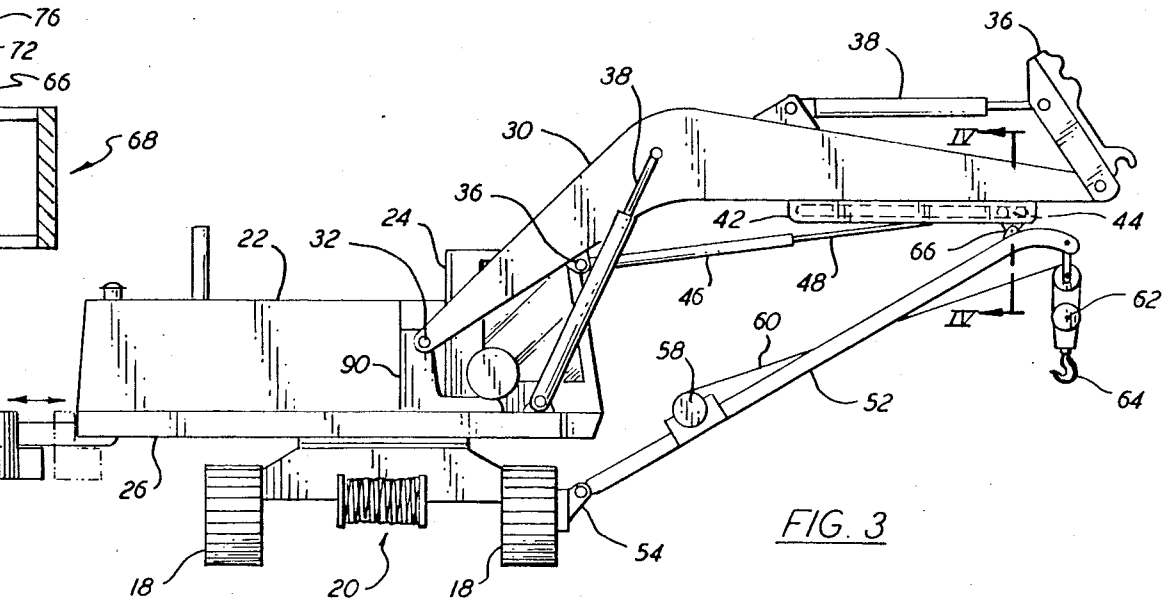
FIG. 3 is a front elevation of the machine of FIG. 1, showing its booms in a lowered position.

With reference to FIGS. 1–3 of the drawing, a crane-type hydraulic excavator machine 10 is shown to have an undercarriage 12, an overcarriage 14, and a front attachment 16. The undercarriage 12 consists basically of a tractor assembly 18 and a carbody and swing bearing assembly 20. The overcarriage 14 of the excavator machine 10 has an engine compartment 22 which contains the prime mover engine for the machine and also contains the hydraulic system, an operator's cab 24, a platform 26 which is mounted for swingable action on the carbody and swing bearing assembly 20, and a counterpoise 28 at the end remote from the cab 24. As shown in FIG. 3, the counterpoise 28 can be extended outward, if needed to balance a heavy load.

The front attachment 16 of the machine 10 is formed of a dog-leg or arched boom 30 whose proximal end is mounted by means of a pivot pin 32 to the undercarriage 14. A double-acting hydraulic boom cylinder 34 has a cylinder end mounted to the platform 26 and has a rod end connected to the arch of the boom 30. A quick-disconnect shoe 36 discussed in greater detail in my co-pending patent application Ser. No. 795,102, filed Nov. 4, 1985, is rockably mounted at the distal end of the boom 30, and a stick cylinder 38 has a cylinder end mounted on the boom 30 and a cylinder rod coupled to a point, on the quick-disconnect shoe 36, spaced from its mounting on the distal end of the boom 30. The shoe 36 permits secure attachment of a desired stick (not shown), e.g. a stick having a shovel end or a shear end, and facilitates removal of the stick when it is not needed. A boom trolley system 40 is disposed on the underside of the boom 30, and principally on its distal half. This system has a trolley track or rail 42 which extends along the underside of the boom 30 a substantial portion of that part of the boom 30 beyond the arch. A trolley member 44 travels the length of the track 42 and is driven by a double-acting hydraulic trolley cylinder 46. The latter has one end attached to the boom 30 towards the latter's proximal end, and has a cylinder rod 48 (withdrawn in FIG. 1 and extended in FIG. 3) connected to a point on the trolley member 44.

A sideboom assembly 50, generally of A-frame configuration, has a pair of legs 52 that are detachably mounted to a mounting bracket 54, the latter being attached to one side of the tractor 18. Here, the lower or proximal ends of the legs 52 are pivotally mounted on the bracket 54 by means of removable mounting pins 55. A suspending lug 56 projects forward at the top or distal end of the side boom assembly 50, and a lifting device can be suspended from this lug 56.

A hydraulic power winch 58 is mounted on the sideboom assembly 50 and has a lifting cable 60 wound thereabout and extending to a pulley block 62 that depends from the lug 56. A lifting hook 64 is then suspended from the block 62.

A connecting lug 66 at the back side of the distal end of the sideboom assembly 50 is removably connected to the trolley member 44.

Figure 4:
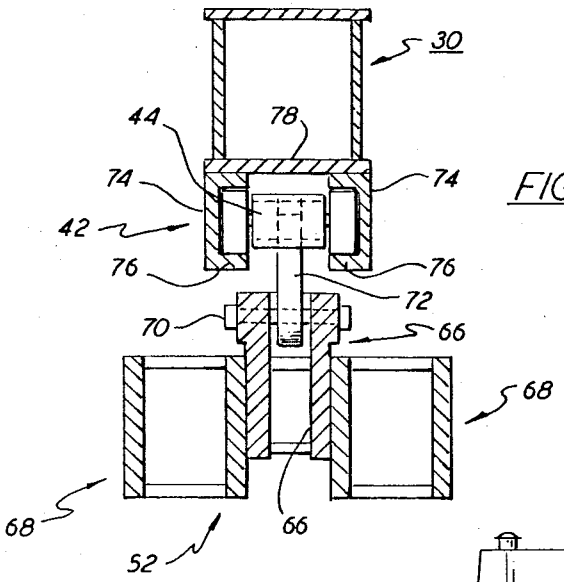
FIG. 4 is a section taken along lines IV—IV of FIG. 3.

As shown in FIG. 4, the legs 52 of the sideboom assembly 50 in this embodiment are box-type beams 68, with the lug 66 here formed as a two-plate member welded to facing side flanges of the beams 68. A removable connecting pin 70 pivotally couples the connecting lug 66 to an eye member 72 which depends from the trolley member 44.

As further shown in cross section in FIG. 4, the trolley track or rail 42 is formed of a pair of channel members having webs 74 and flanges 76, with the lower flanges 76 providing a surface on which the trolley member 44 can roll, and with the upper flanges 76 being welded to a flange plate 78 of the main boom 30.

Figure 5:
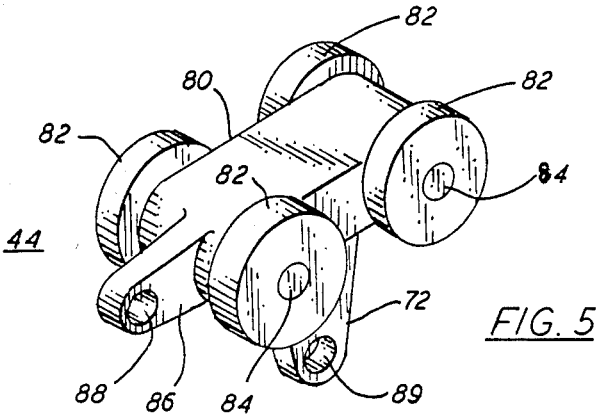
FIG. 5 shows detail of a trolley member employed in the described embodiment.

As shown in FIG. 5, the trolley member 44 has a unitary body 80 on which there are four rollers or wheels 82 affixed on axles or pivots 84. The rollers 82 are attached, one at each corner of the body 80, so that there are two rollers 82 on each side. A rear protuberance 86 has an opening or eye 88 to which the trolley cylinder rod 48 is attached, and the depending eye member 72 has an eye or opening 89 for receiving the pin 70.

The machine operator, from a position within the cab 24, can actuate the cylinders 46 and 34 to raise and lower the side boom 50 and the main boom 30 between their lowered position (FIG. 3) and their raised position (FIGS. 1 and 2). The counterpoise 28 can be extended when the booms are extended, as in the lowered position of FIG. 3. The booms 30 and 50 can be moved to any desired intermediate position as selected by the operator.

The operator can easily position a pipe or other heavy object over a trench, the object being suspended, e.g., from the hook 64, to a desired position laterally of the tractor 18 of the machine 10. When the machine is no longer needed for sideboom work, the sideboom assembly can be removed, and a stick attached to the quick-disconnect shoe 36. Then the machine 10 can be employed for straight forward excavator work.

While the invention has been described in detail herein with respect to a preferred embodiment, it should be understood that the invention is not limited to that embodiment, and that many modifications and variations thereof would be apparent to those skilled in the art without departure from the scope and spirit of this invention, as defined in the appended claims.

I claim:

1. A crane-type machine comprising a base including a transport assembly for moving the machine in a forward and reverse direction; an overcarriage swingably mounted on said base; a main boom having a proximal end and a distal end, the proximal end being pivotally mounted on said overcarriage for motion in a generally vertical arc; means for raising and lowering said main boom in said arc, means for swinging said overcarriage in a generally horizontal plane to extend said main boom transversely to said transport assembly; a side boom having a proximal end and a distal end; mounting bracket means attached to a side of said transport assembly for pivotally mounting the proximal end of said side boom for swinging motion of said side boom in a generally vertical arc; a sliding coupling attached to the underside of the main boom for coupling the distal end of the side boom to said main boom so that the side boom distal end travels over a substantial portion of the length of said main boom, said portion being located distally on said main boom; means for urging the the sliding coupling to an operator-selected position along said main boom; and lifting means suspended from the distal end of said side boom for lifting an object.

2. The machine of claim 1 in which said sliding coupling includes a trolley track affixed onto a lower side of said main boom, a trolley member slidably mounted in said trolley track having an attachment member protruding out of said trolley track, and means for attaching said attachment member to the distal end of said side boom.

3. The machine of claim 2 in which said means for urging the side boom includes a double-acting hydraulic cylinder connected to the main boom near the proximal end thereof and a cylinder rod connected to said trolley member.

4. The machine of claim 2 wherein said distal end of said side boom includes a forward lug from which said lifting means is suspended and a rearward lug for coupling to the attachment member of said trolley member.

5. The machine of claim 4 wherein said attaching means includes a pin for removably attaching said rearward lug to said attachment member.

6. The machine of claim 1 wherein said mounting bracket means includes a bracket member affixed on said transport assembly and pins for removably mounting said side boom to said bracket members.

7. The machine of claim 1 wherein said lifting means includes a pulley block suspended from said side boom distal end, and further includes a power winch mounted on said side boom, a lifting cable wound about said winch and extending over said pulley block, and a lifting device suspended beneath said block from said lifting cable.

* * * * *